US011970258B2

(12) United States Patent
Takeda

(10) Patent No.: US 11,970,258 B2
(45) Date of Patent: Apr. 30, 2024

(54) OUTBOARD MOTOR

(71) Applicant: YAMAHA HATSUDOKI KABUSHIKI KAISHA, Iwata (JP)

(72) Inventor: Kentaro Takeda, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 465 days.

(21) Appl. No.: 17/363,257

(22) Filed: Jun. 30, 2021

(65) Prior Publication Data

US 2022/0017201 A1 Jan. 20, 2022

(30) Foreign Application Priority Data

Jul. 16, 2020 (JP) ..... 2020-121893

(51) Int. Cl.
*B63H 20/10* (2006.01)
*B63H 1/14* (2006.01)
*B63H 21/17* (2006.01)

(52) U.S. Cl.
CPC ..... *B63H 20/10* (2013.01); *B63H 1/14* (2013.01); *B63H 21/17* (2013.01)

(58) Field of Classification Search
CPC ..... B63H 20/10; B63H 1/14; B63H 21/17
See application file for complete search history.

(56) References Cited

U.S. PATENT DOCUMENTS 4,449,945 A * 5/1984 Ferguson ..... B63H 20/12 440/61 G
8,858,280 B1 10/2014 Wiegele et al.
11,034,465 B1 * 6/2021 Brady ..... G06Q 10/20

FOREIGN PATENT DOCUMENTS

GB 2083787 A * 3/1982 ..... B63H 21/38

* cited by examiner

*Primary Examiner* — Stephen P Avila
(74) *Attorney, Agent, or Firm* — Keating & Bennett, LLP

(57) ABSTRACT

An outboard motor includes a bracket, an outboard motor body, a harness, and a seal. The bracket is attached to a transom of a boat. The outboard motor body is supported by the bracket. The harness extends from the outboard motor body through an opening of the transom into the boat. The seal is detachably attached to the opening to hold the harness.

8 Claims, 10 Drawing Sheets

OUTBOARD MOTOR

CROSS REFERENCE TO RELATED APPLICATIONS

This application claims the benefit of priority to Japanese Patent Application No. 2020-121893 filed on Jul. 16, 2020. The entire contents of this application are hereby incorporated herein by reference.

BACKGROUND OF THE INVENTION

1. Field of the Invention

The present invention relates to an outboard motor.

2. Description of the Related Art

An outboard motor includes a bracket and an outboard motor body. The outboard motor body is connected to a transom of a boat via the bracket. As disclosed in U.S. Pat. No. 8,858,280, the outboard motor includes a harness for connecting the outboard motor body and equipment disposed in the boat. The harness extends from the outboard motor body, over the transom, into the boat.

As mentioned above, when the harness passes above the transom, the degree of freedom in the layout of the harness is low. On the other hand, when the transom is provided with an opening and the harness extends through the opening, the degree of freedom in the layout of the harness is high. However, in that case, it is necessary to provide a seal between the opening and the harness in order to prevent water from entering the boat.

For example, the space between the opening and the harness can be sealed by filling the space between the opening and the harness with liquid silicone and solidifying the silicone. However, in that case, it becomes difficult to remove the harness from the opening. Therefore, it becomes difficult to remove the outboard motor from the boat, and the maintainability is lowered. In addition, every time the outboard motor is attached to a boat, it is necessary to fill and solidify the silicone, which is complicated.

SUMMARY OF THE INVENTION

Preferred embodiments of the present invention improve the degree of freedom in the layout of a harness and facilitate attachment and detachment of outboard motors from boats.

An outboard motor according to a preferred embodiment of the present invention that is to be attached to a boat including a transom provided with an opening includes a bracket, an outboard motor body, a harness, and a seal. The bracket is attached to the transom. The outboard motor body is supported by the bracket. The harness extends from the outboard motor body through the opening and into the boat. The seal holds the harness and is detachably attached to the opening.

In an outboard motor according to a preferred embodiment of the present invention, the harness extends from the outboard motor body through the transom opening and into the boat. Therefore, the degree of freedom in the layout of the harness is improved. In addition, the seal holds the harness and is detachably attached to the opening. Therefore, when removing the outboard motor, the harness is easily removed from the opening together with the seal. As a result, the outboard motor is easily attached to and detached from the boat.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
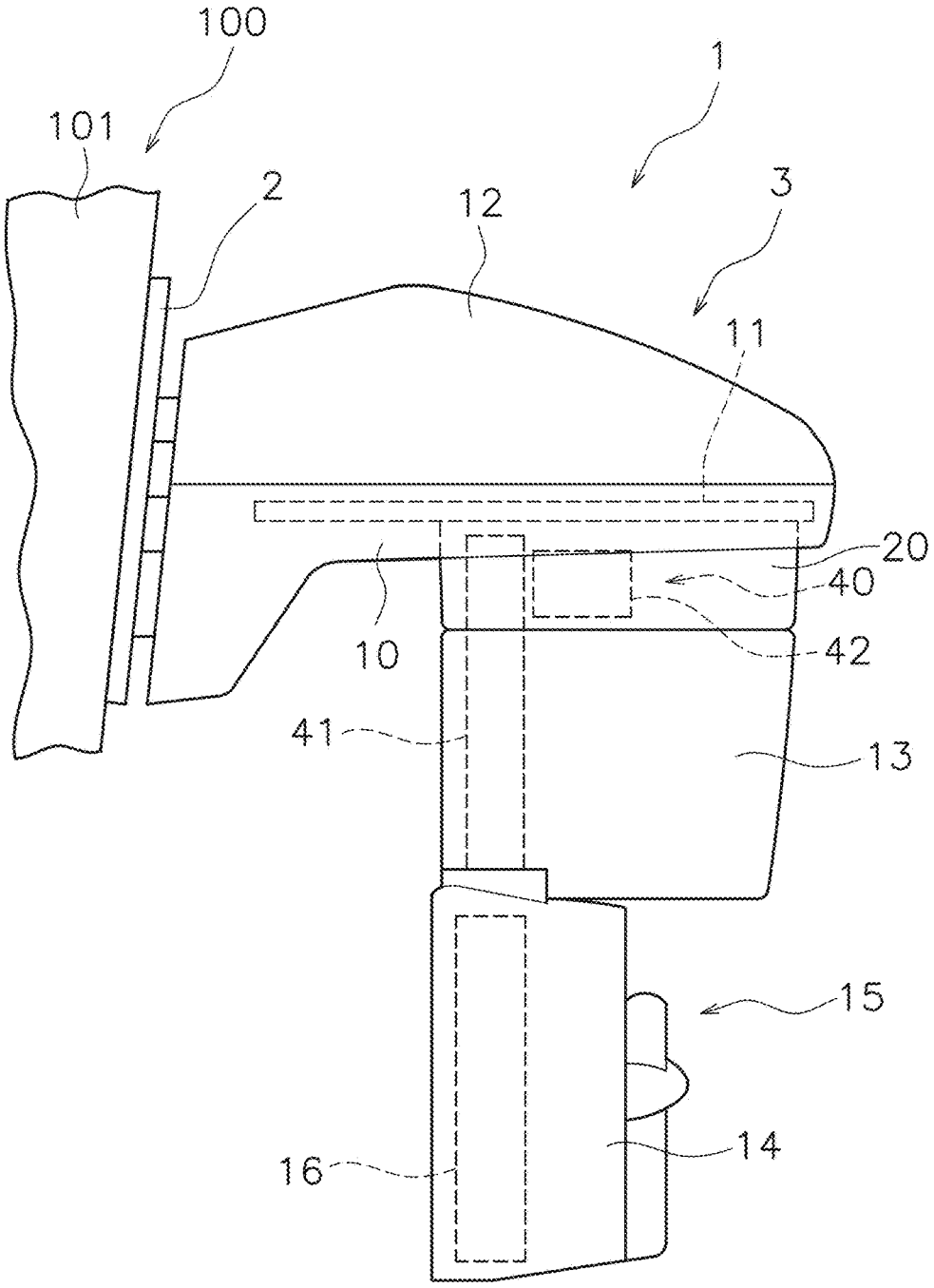
FIG. 1 is a side view of an outboard motor according to a preferred embodiment of the present invention.
Figure 2:
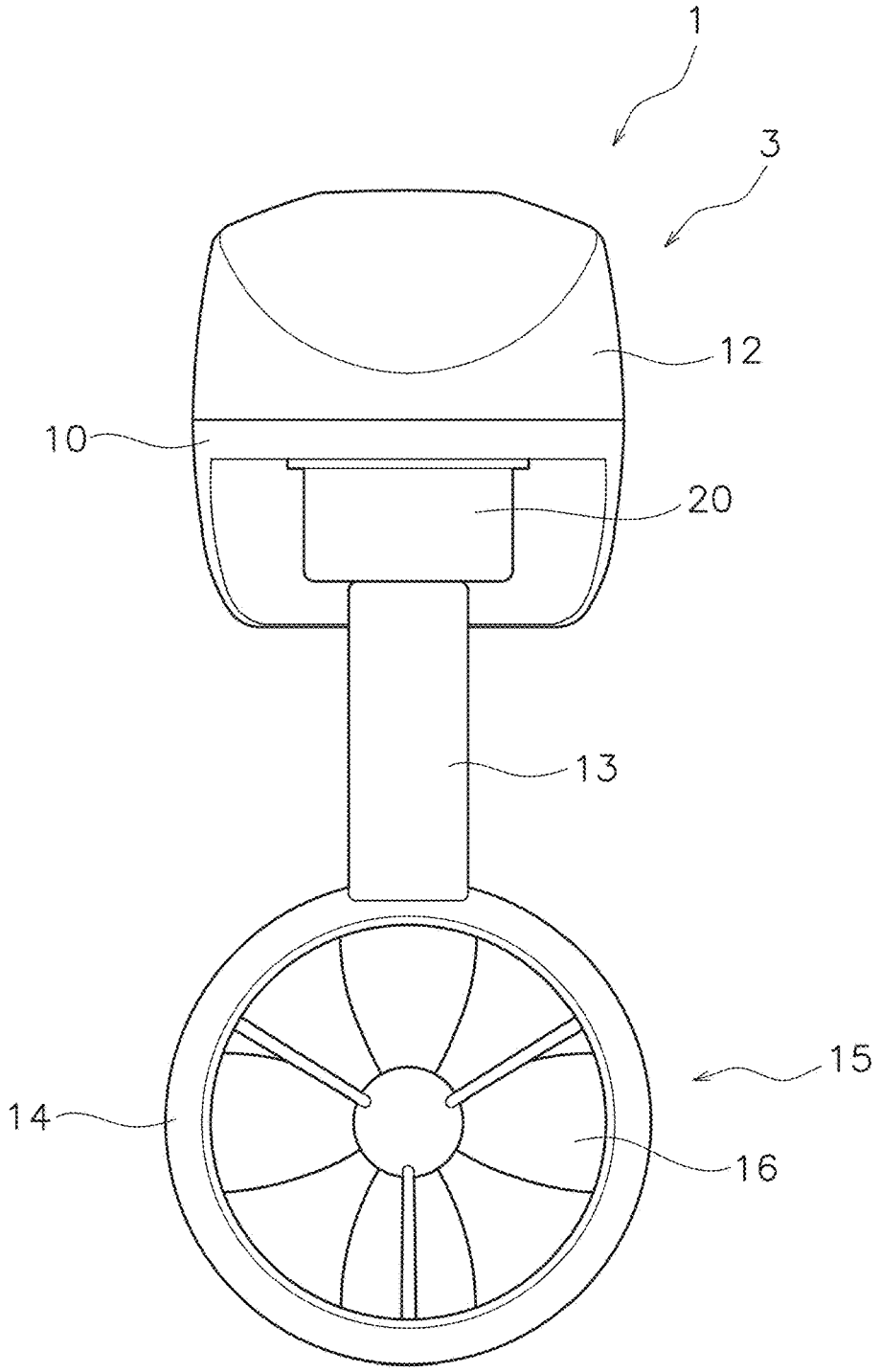
FIG. 2 is a rear view of the outboard motor.

Hereinafter, outboard motors according to preferred embodiments of the present invention will be described with reference to the drawings. FIG. 1 is a side view of an outboard motor 1 according to a preferred embodiment of the present invention. FIG. 2 is a rear view of the outboard motor 1. As illustrated in FIG. 1, the outboard motor 1 is attached to a transom 101 of a boat 100. The outboard motor 1 includes a bracket 2 and an outboard motor body 3. The bracket 2 is attached to the transom 101 of the boat 100. The outboard motor 1 is attached to the boat 100 via the bracket 2. The outboard motor body 3 is supported by the bracket 2.

The outboard motor body 3 includes a cover 10, a base 11, a cowl 12, a steering mechanism case 20, an upper housing 13, a lower housing 14, and a drive unit 15. The cover 10 is attached to the base 11. The base 11 is connected to the bracket 2. The cowl 12 is located above the base 11. The cowl 12 is attached to the base 11. The steering mechanism case 20 is located below the base 11. The steering mechanism case 20 is attached to the base 11. The upper housing 13 is located below the steering mechanism case 20. The lower housing 14 is located below the upper housing 13. The drive unit 15 is located in the lower housing 14.

Figure 3:
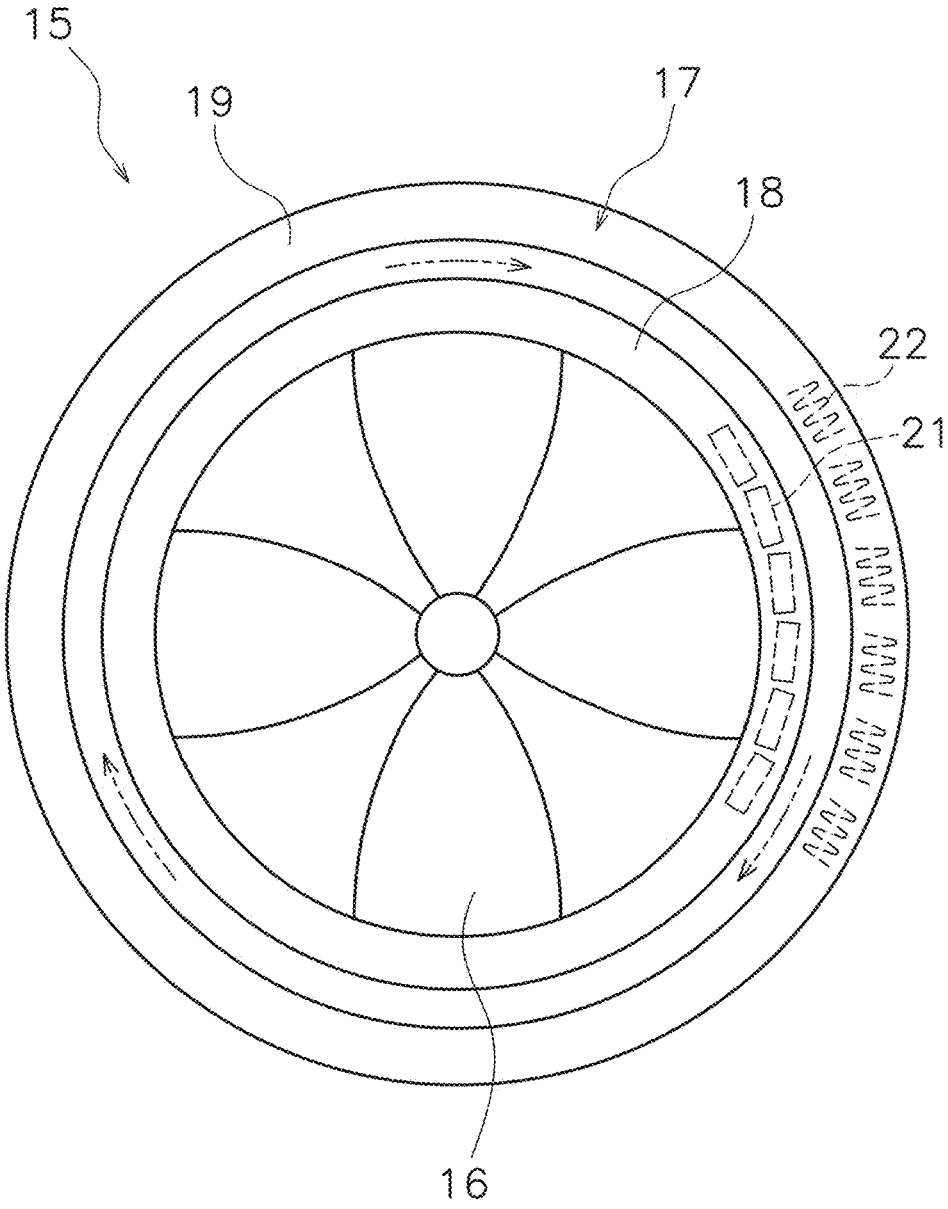
FIG. 3 is a schematic view showing a configuration of a drive unit.

The drive unit 15 generates a thrust to propel the boat 100. FIG. 3 is a schematic view showing a configuration of the drive unit 15. As illustrated in FIG. 3, the drive unit 15 includes a propeller 16 and a drive motor 17. The drive motor 17 rotates the propeller 16. The drive motor 17 is, for example, an electric motor. The outboard motor 1 generates the propulsive force of the boat 100 by rotating the propeller 16 with the drive motor 17. The drive motor 17 includes a rotor 18 and a stator 19. The rotor 18 and the stator 19 each have a tubular shape. The rotor 18 is located radially inward of the stator 19. The rotor 18 is rotatably supported by the lower housing 14. The rotor 18 rotates with respect to the stator 19. The propeller 16 is located radially inward of the rotor 18. The propeller 16 is fixed to the rotor 18. The propeller 16 rotates together with the rotor 18. The rotor 18 includes a plurality of permanent magnets 21. The plurality of permanent magnets 21 are located along the circumferential direction of the rotor 18. In FIG. 3, reference numeral 21 indicates only one of the plurality of permanent magnets 21, and the reference numerals of the other permanent magnets 21 are omitted.

The stator 19 is located radially outward of the rotor 18. The stator 19 is fixed to the lower housing 14. The stator 19 includes a plurality of coils 22. The plurality of coils 22 are located along the circumferential direction of the stator 19. By energizing the plurality of coils 22, an electromagnetic force that rotates the rotor 18 is generated. In FIG. 3, reference numeral 22 indicates only one of the plurality of coils 22, and the reference numerals of the other coils 22 are omitted.

As illustrated in FIG. 1, the outboard motor 1 includes a steering mechanism 40. The steering mechanism 40 is located in the steering mechanism case 20. The steering mechanism 40 includes a steering shaft 41 and a steering motor 42. The steering shaft 41 extends in the vertical direction of the outboard motor 1. The steering mechanism 40 rotates the drive unit 15 around the steering shaft 41. As a result, the boat 100 is steered. The steering motor 42 is connected to the steering shaft 41 via a transmission mechanism such as a gear (not illustrated). The steering motor 42 is, for example, an electric motor. The steering motor 42 rotates the steering shaft 41.

Figure 4:
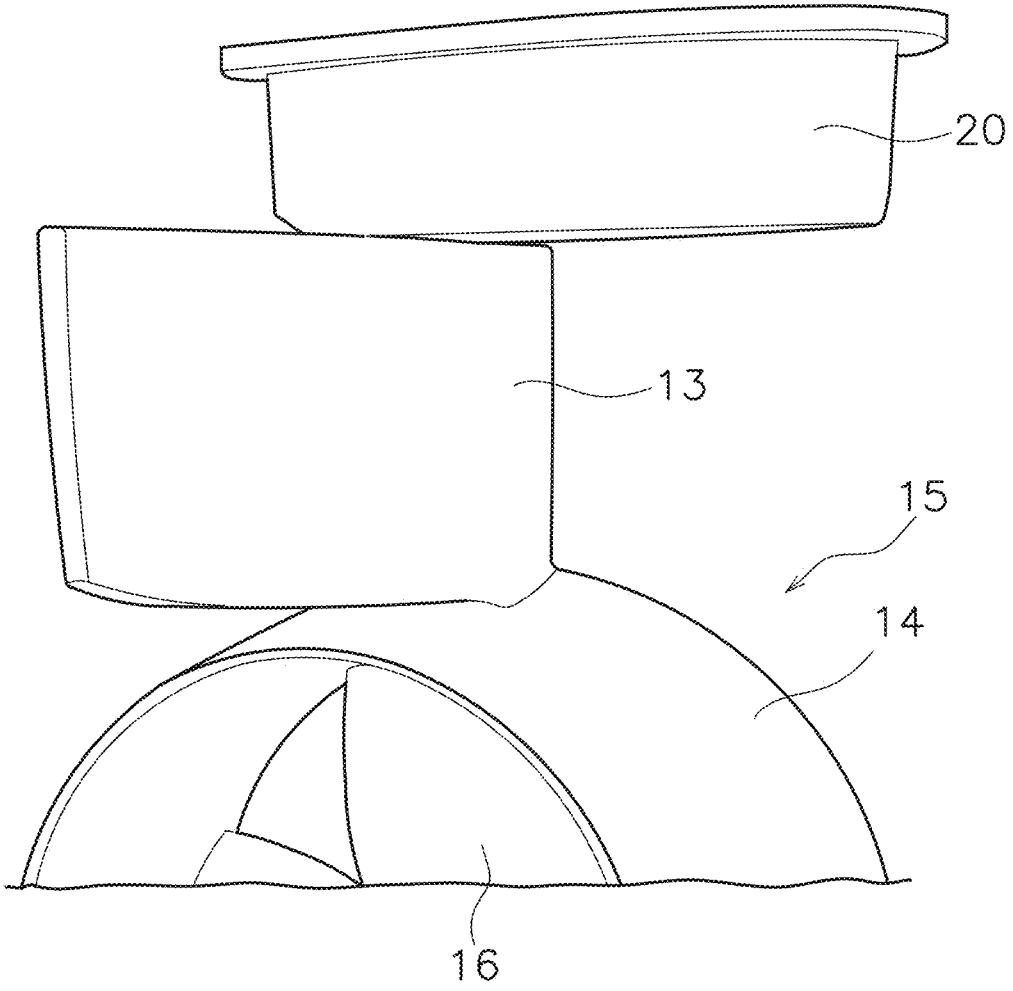
FIG. 4 is a perspective view showing an upper housing and the drive unit when the outboard motor is being steered.

Specifically, the steering shaft 41 is connected to the upper housing 13. As illustrated in FIG. 4, the upper housing 13 and the drive unit 15 are rotatable with respect to the base 11 and the steering mechanism case 20. When the steering motor 42 rotates the steering shaft 41, the upper housing 13 and the drive unit 15 rotate around the steering shaft 41 with respect to the base 11 and the steering mechanism case 20.

Figure 5:
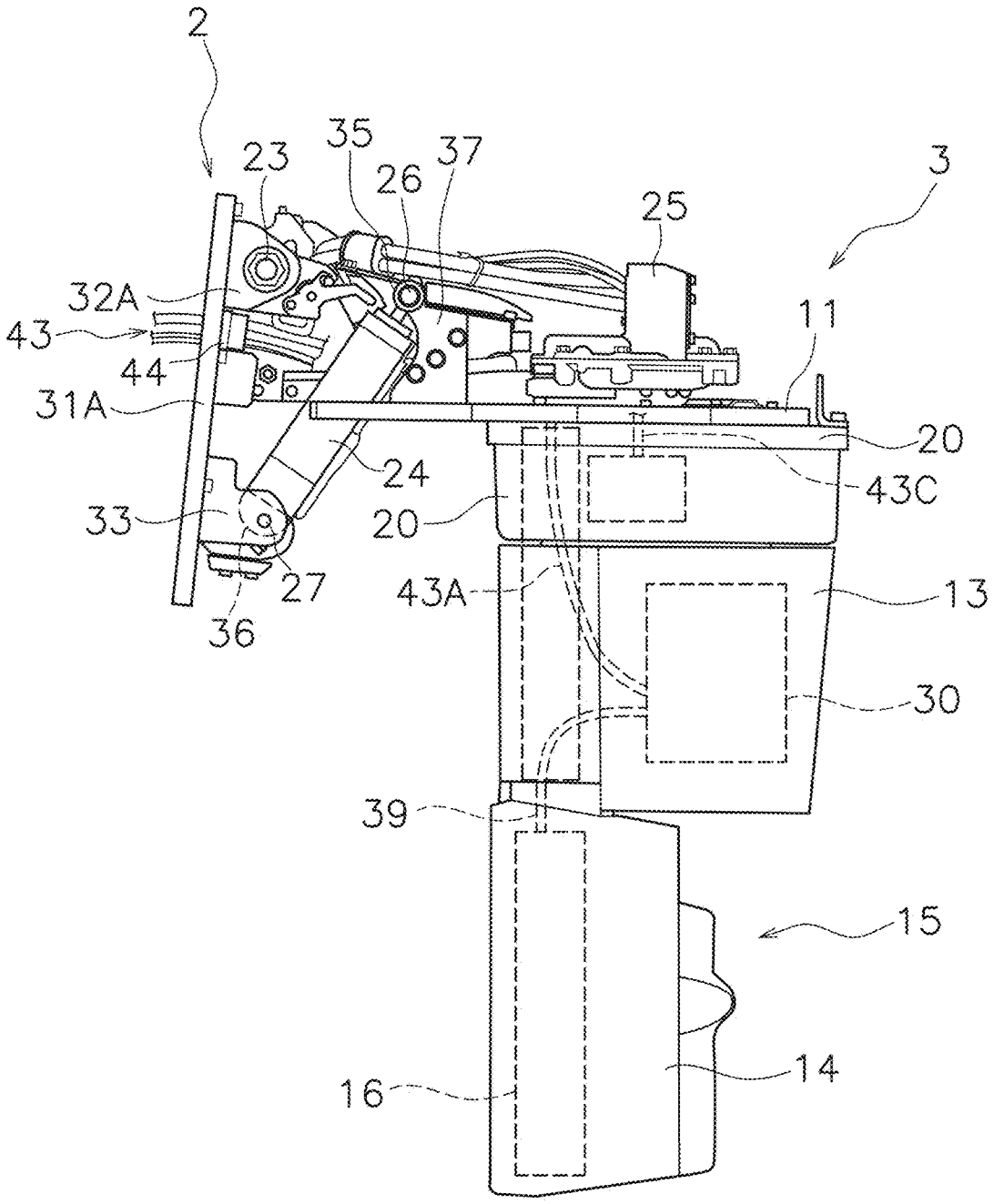
FIG. 5 is a side view of the outboard motor from which a cowl has been removed.
Figure 6:
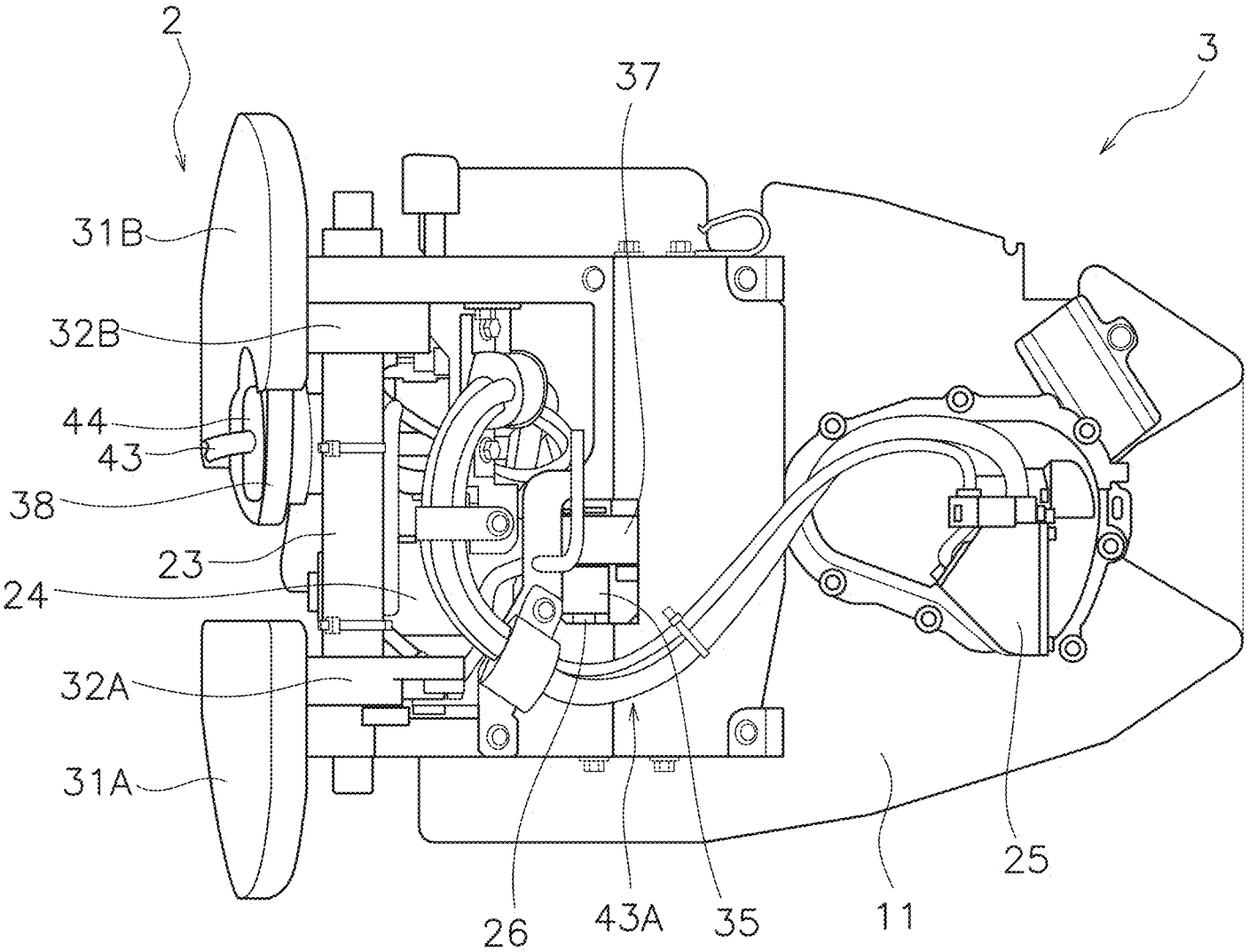
FIG. 6 is a top view of the outboard motor from which the cowl has been removed.

FIG. 5 is a side view of the outboard motor 1 from which the cowl 12 has been removed. FIG. 6 is a top view of the outboard motor 1 from which the cowl 12 has been removed. As illustrated in FIGS. 5 and 6, the outboard motor 1 includes a tilt shaft 23, a tilt cylinder 24, an upper connecting pin 26, and a lower connecting pin 27. The tilt shaft 23 is supported by the bracket 2. The tilt shaft 23 rotatably connects the outboard motor body 3 to the bracket 2. The tilt shaft 23 extends in the left-right direction of the outboard motor 1. The tilt shaft 23 is located in the cowl 12.

The bracket 2 includes a left bracket 31A, a right bracket 31B, a left support 32A, a right support 32B, and a lower support 33. The left bracket 31A and the right bracket 31B are separate from each other. The left bracket 31A and the right bracket 31B are located on the left and right sides apart from each other. The left bracket 31A and the right bracket 31B each have a plate shape extending along the transom 101. The left bracket 31A and the right bracket 31B are fixed to the transom 101.

The left support 32A protrudes from the left bracket 31A. The right support 32B protrudes from the right bracket 31B. The lower support 33 projects from the left bracket 31A. The lower support 33 may protrude from the right bracket 31B. The left support 32A and the right support 32B are spaced apart from each other in the left-right direction. The tilt shaft 23 is connected to the left support 32A and the right support 32B. The lower support 33 is located below the left support 32A and the right support 32B. The tilt cylinder 24 is connected to the lower support 33.

The tilt cylinder 24 is located in the cowl 12. The tilt cylinder 24 is, for example, a hydraulic cylinder. A hydraulic pump and a motor to drive the hydraulic pump are integrated in the tilt cylinder 24. However, the hydraulic pump and the motor may be separate from the tilt cylinder 24.

The tilt cylinder 24 includes an upper connector 35 and a lower connector 36. The upper connector 35 is located at one end of the tilt cylinder 24. The lower connector 36 is located at the other end of the tilt cylinder 24. The upper connector 35 is connected to the outboard motor body 3 by the upper connecting pin 26. Specifically, the outboard motor body 3 includes a cylinder connector 37. The cylinder connector 37 is supported by the base 11. The cylinder connector 37 projects upward from the base 11. The upper connector 35 is connected to the cylinder connector 37. The lower connector 36 is connected to the bracket 2 by the lower connecting pin 27. Specifically, the lower connector 36 is connected to the lower support 33.

Figure 7:
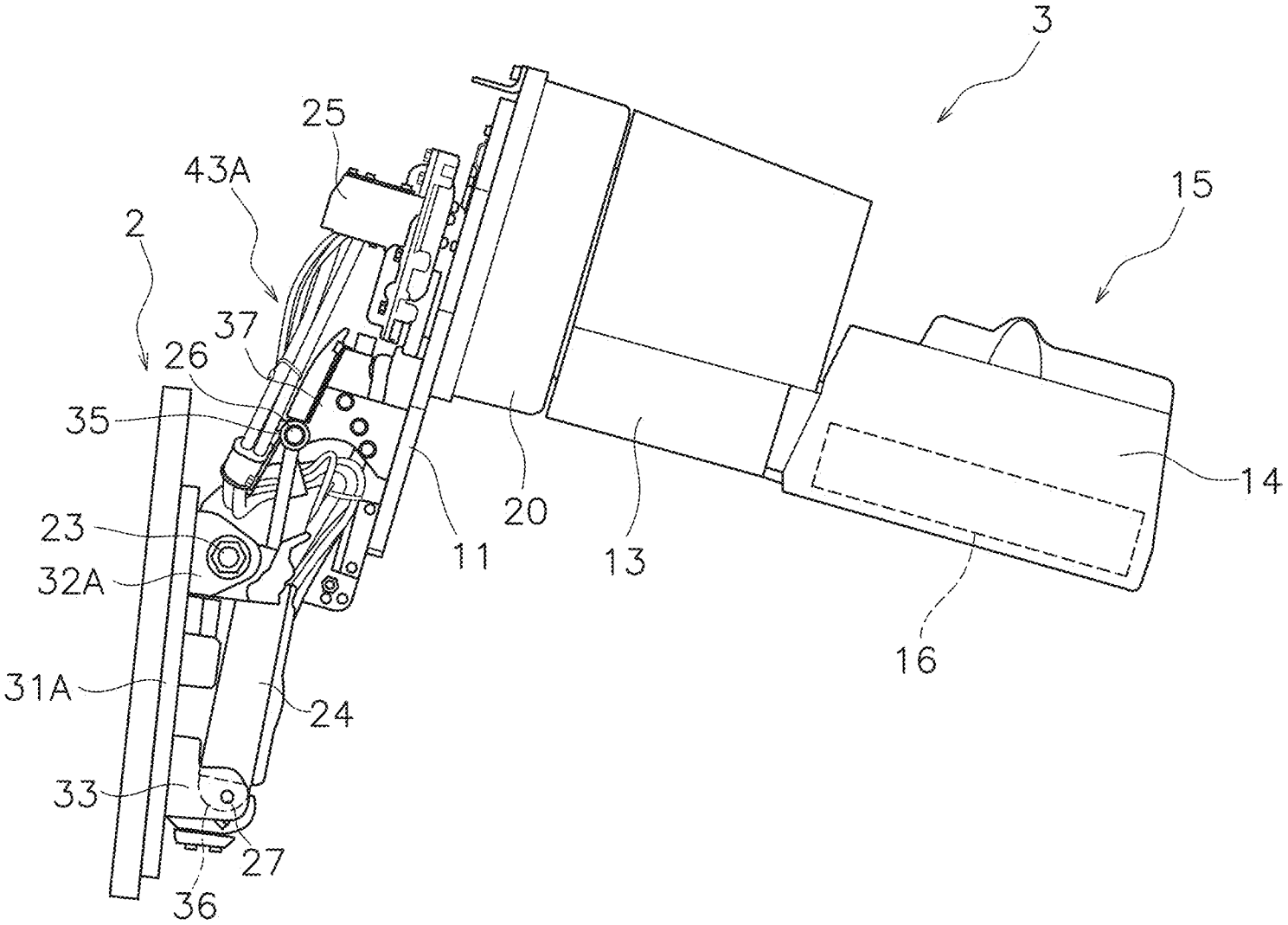
FIG. 7 is a side view showing the outboard motor at a full tilt-up position.

The tilt cylinder 24 expands and contracts to rotate the outboard motor body 3 around the tilt shaft 23 between a full tilt-up position and a full trim-in position. FIG. 5 shows the outboard motor 1 at the full trim-in position. FIG. 7 shows the outboard motor 1 in the full tilt-up position. As illustrated in FIG. 5, in the full trim-in position, the propeller 16 is located below the lower connecting pin 27. As illustrated in FIG. 7, in the full tilt-up position, the propeller 16 is located above the lower connecting pin 27.

Figure 8:
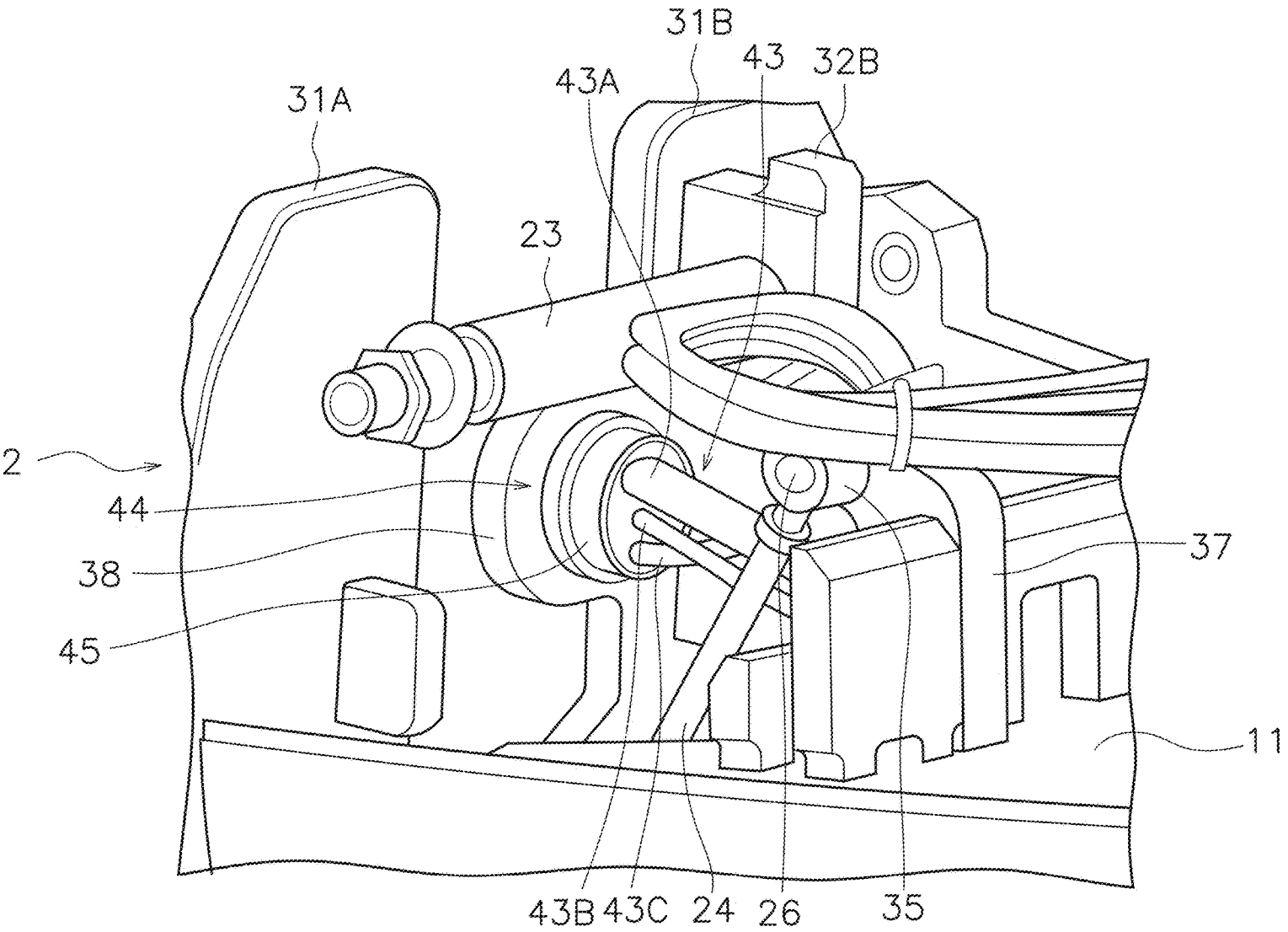
FIG. 8 is an enlarged perspective view of the outboard motor from which the cowl has been removed.
Figure 9:
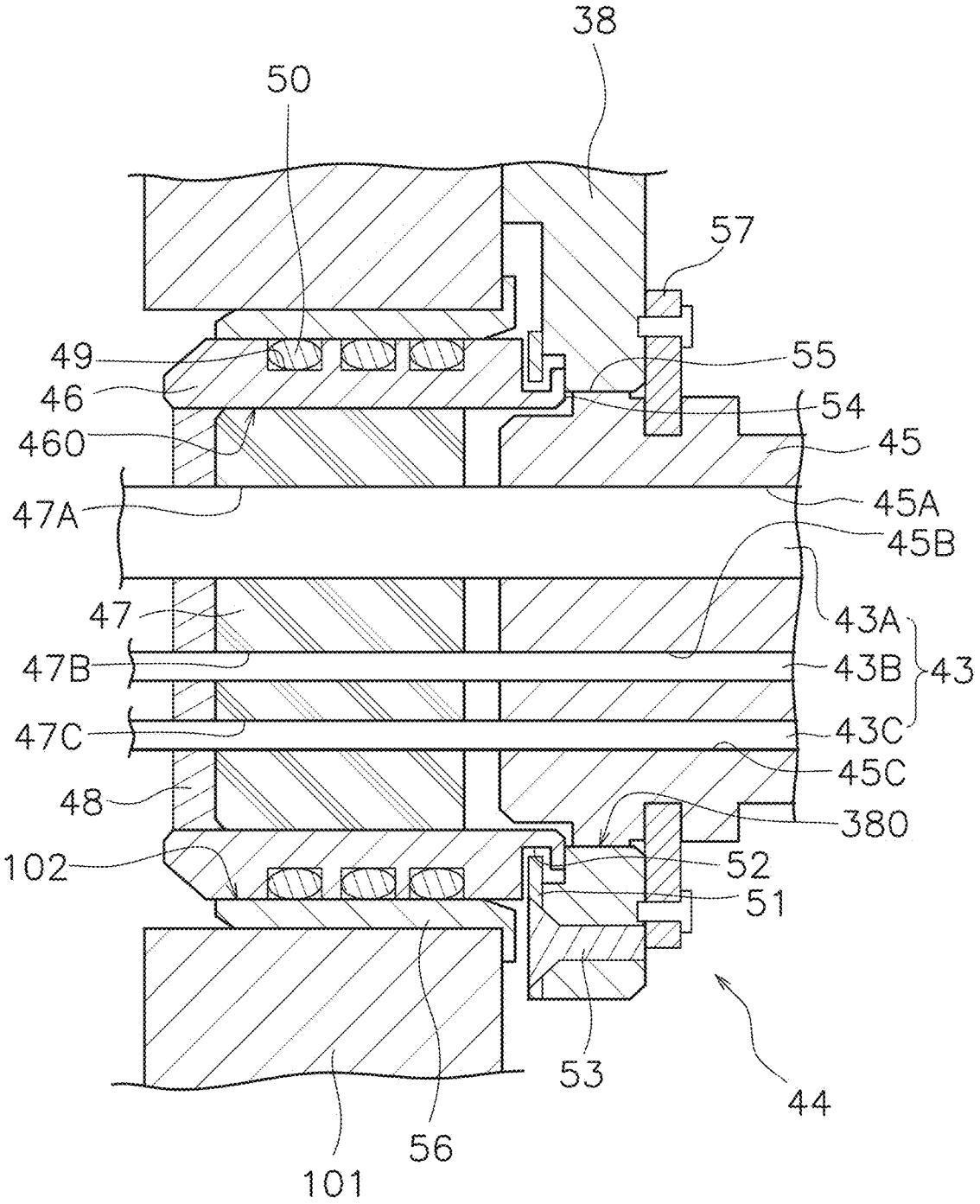
FIG. 9 is a vertical sectional view of a transom and a bracket.

FIG. 8 is an enlarged perspective view of the outboard motor 1 from which the cowl 12 has been removed. FIG. 9 is a vertical cross-sectional view of the transom 101 and the bracket 2. For ease of understanding, the left support 32A and the cylinder connector 37 are omitted in FIG. 8. As illustrated in FIGS. 8 and 9, a pipe 56 is attached to the transom 101, and an opening 102 is provided in the pipe 56. The outboard motor 1 includes a harness 43. The harness 43 is threaded through the opening 102 of the transom 101.

The harness 43 extends from the outboard motor body 3 through the opening 102 and into the boat. A portion of the harness 43 is located above the base 11. A portion of the harness 43 is covered with the cowl 12. The harness 43 includes a drive cable 43A, a pump cable 43B, and a steering cable 43C. The drive cable 43A is connected to the MCU 30 (motor control unit) from inside the boat 100 through the terminal case 25. The MCU 30 is located in the upper housing 13. The MCU 30 is connected to the drive motor 17 via a three-phase wire 39. The drive cable 43A includes a plurality of cables including a strong electric cable and a light electric cable. The pump cable 43B is connected to the tilt cylinder 24. Electric power is supplied to the tilt cylinder 24 via the pump cable 43B. The steering cable 43C is connected to the steering motor 42. Electric power is supplied to the steering motor 42 via the steering cable 43C.

As illustrated in FIG. 9, the outboard motor 1 includes a seal 44. The seal 44 is detachably attached to the opening 102. The seal 44 holds the harness 43. The seal 44 has a tubular or substantially tubular shape, for example. The harness 43 extends through the seal 44 in the axial direction of the seal 44. The seal 44 seals between the harness 43 and the opening 102 so as to prevent water from entering therethrough.

Figure 10:
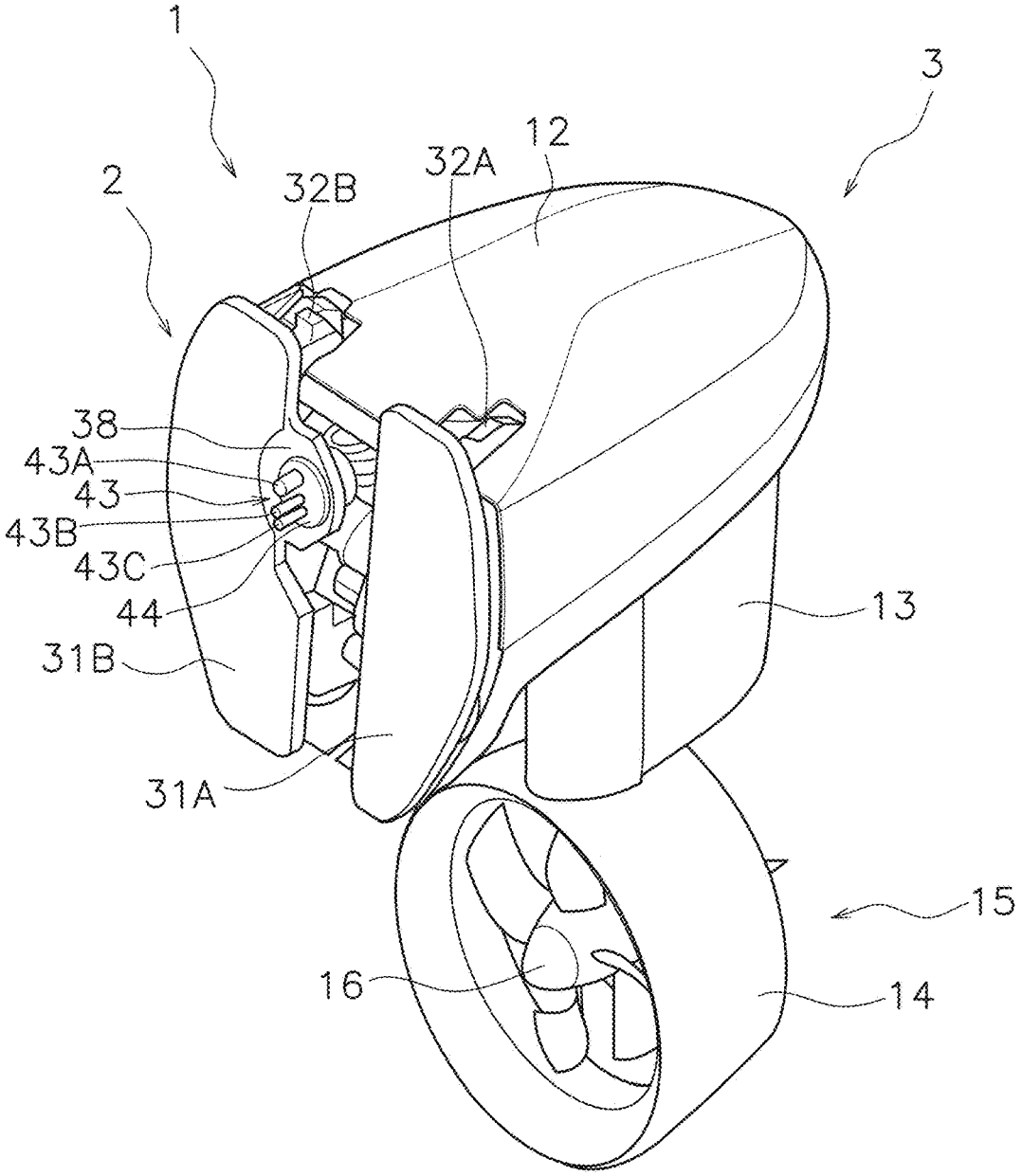
FIG. 10 is a perspective view of the outboard motor.

FIG. 10 is a perspective view of the outboard motor 1. As illustrated in FIGS. 6 and 10, the bracket 2 includes a seal support 38. The seal support 38 is located between the left bracket 31A and the right bracket 31B. The seal support 38 is integral with the right bracket 31B. The seal support 38 projects from the right bracket 31B toward the left bracket 31A. As illustrated in FIG. 9, the seal support 38 includes a hole 380. The hole 380 faces the opening 102 of the transom 101. The seal 44 and the harness 43 extend through the hole 380 of the seal support 38 and the opening 102 of the transom 101.

As illustrated in FIG. 8, the seal 44 is located below the tilt shaft 23. From the top view, the seal 44 overlaps the tilt shaft 23. The harness 43 extends below the tilt shaft 23. The seal 44 and the harness 43 are located below the tilt shaft 23 and above the base 11. As illustrated in FIG. 6, the seal 44 is located between the left support 32A and the right support 32B.

The seal 44 includes a holder 45, a bush 46, and a grommet 47. The holder 45 is located in the hole 380 of the seal support 38. The holder 45 is made of an elastic material such as rubber. The holder 45 is fixed to the seal support 38 by a metal plate 57. The holder 45 includes holes 45A, 45B, and 45C. The holes 45A, 45B, and 45C extend in the axial direction of the holder 45. The drive cable 43A, the pump cable 43B, and the steering cable 43C extend through the holes 45A, 45B, and 45C, respectively.

The bush 46 is located in the opening 102 of the transom 101. The bush 46 is detachably attached to the opening 102. The bush 46 is made of a resin material, for example. Alternatively, the bush 46 may be made of metal. The bush 46 includes a hole 460. A plurality of seal grooves 49 are provided on the outer peripheral surface of the bush 46. The plurality of seal grooves 49 are located side by side in the axial direction of the bush 46. O-rings 50 are located in each of the plurality of seal grooves 49. The O-rings 50 are located between the outer surface of the bush 46 and the inner surface of the opening 102. The O-rings 50 seal between the bush 46 and the opening 102. The O-rings 50 seal between the seal 44 and the opening 102. In the drawings, reference numerals indicate only some of the plurality of seal grooves 49 and the O-rings 50, and the reference numerals of the other seal grooves 49 and the O-rings 50 are omitted.

The bush 46 is attached to the seal support 38. The bush 46 projects from the seal support 38 toward the transom 101. The bush 46 is fixed to the seal support 38 by a plate-shaped stay 51. A mounting groove 52 is provided on the outer peripheral surface of the bush 46. A portion of the stay 51 is located in the mounting groove 52. The stay 51 is fixed to the seal support 38 by a fixing member 53 such as a screw.

The grommet 47 is located in the hole 460 of the bush 46. The grommet 47 is detachably attached to the bush 46. The grommet 47 is made of an elastic material such as rubber. The grommet 47 extends through the hole 460 of the bush 46. The grommet 47 fills the space between the bush 46 and the harness 43. The grommet 47 includes a plurality of holes 47A, 47B, and 47C. The plurality of holes 47A, 47B, and 47C extend in the axial direction of the grommet 47. Specifically, the grommet 47 includes a first hole 47A, a second hole 47B, and a third hole 47C. The drive cable 43A extends through the first hole 47A. The pump cable 43B extends through the second hole 47B. The steering cable 43C extends through the third hole 47C.

A sealant 48 is filled between the end of the bush 46 and the end of the grommet 47. The sealant 48 is, for example, a solidified liquid silicone. The inner diameter of the hole 460 of the bush 46 is smaller than the inner diameter of the hole 380 of the seal support 38. Therefore, a step 54 is provided between the inner peripheral surface of the bush 46 and the inner peripheral surface of the seal 44. The holder 45 includes a flange 55. The flange 55 projects from the outer peripheral surface of the holder 45. The flange 55 faces the step 54.

In the outboard motor 1 according to the present preferred embodiment, the harness 43 extends from the outboard motor body 3 through the opening 102 of the transom 101 and into the boat 100. Therefore, the degree of freedom in the layout of the harness 43 is improved. Further, the seal 44 holds the harness 43 and is detachably attached to the opening 102. Therefore, when the outboard motor 1 is removed, the harness 43 together with the seal 44 is easily removed from the opening 102. As a result, the outboard motor 1 is easily attached to and detached from the boat 100.

For example, when the bracket 2 is removed from the boat 100, the seal 44 and the harness 43 are removed from the opening 102 by pulling out the bush 46 from the opening 102. When attaching the bracket 2 to the boat 100, the seal 44 and the harness 43 are attached to the opening 102 by inserting the bush 46 into the opening 102.

Although preferred embodiments of the present invention have been described above, the present invention is not limited to the above-described preferred embodiments, and various modifications can be made without departing from the gist of the present invention.

The configuration of the outboard motor 1 is not limited to that of the above-described preferred embodiments, and may be changed. For example, the drive unit 15 is not limited to the drive motor 17, and may include an internal combustion engine. That is, the outboard motor 1 may rotate the propeller 16 by the driving force of the internal combustion engine instead of the drive motor 17. The internal combustion engine may be located within the cowl 12.

The tilt cylinder 24 is not limited to the hydraulic cylinder, and may be an electric cylinder. The structure of the bracket 2 is not limited to that of the above-described preferred embodiments, and may be changed. For example, the seal support 38 may be integral with the left bracket 31A. Alternatively, the seal support 38 may be separate from the left bracket 31A and the right bracket 31B.

The structure or arrangement of the seal 44 is not limited to that of the above-described preferred embodiments, and may be changed. For example, the shape of the holder 45 may be changed. The shape of the bush 46 may be changed. The shape of the grommet 47 may be changed. The arrangement of the harness 43 is not limited to that of the above-described preferred embodiments, and may be changed. A portion of the drive cable 43A, the pump cable 43B, and the steering cable 43C may be omitted from the harness 43. Alternatively, the harness 43 may include cables other than the drive cable 43A, the pump cable 43B, and the steering cable 43C.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor to be attached to a boat including a transom including an opening, the outboard motor comprising:

a bracket to be attached to the transom;

an outboard motor body supported by the bracket;

a harness extending from the outboard motor body through the opening and into the boat; and a seal that holds the harness and is detachably attached to the opening; wherein the bracket includes a seal support connected to the seal;

the bracket includes a left bracket and a right bracket spaced apart from the left bracket in a left-right direction of the outboard motor;

the seal support is located between the left bracket and the right bracket; and the seal support is integral with the left bracket or the right bracket.

2. The outboard motor according to claim 1, wherein the seal includes:

a bush attached to the opening and including a hole; and a grommet located in the hole to fill a space between the bush and the harness, and the grommet is made of an elastic material.

3. The outboard motor according to claim 2, wherein the seal further includes an O-ring located between an outer surface of the bush and an inner surface of the opening.

4. The outboard motor according to claim 1, wherein the seal support includes a hole; and the harness extends through the hole of the seal support.

5. The outboard motor according to claim 1, further comprising:

a tilt shaft to rotatably support the outboard motor body; wherein the seal is located below the tilt shaft.

6. The outboard motor according to claim 5, wherein the outboard motor body includes a cowl that covers the harness, and a base to which the cowl is attached; and the seal is located below the tilt shaft and above the base.

7. The outboard motor according to claim 1, further comprising a tilt shaft to rotatably support the outboard motor body; wherein the bracket includes:

a left support to support the tilt shaft; and a right support to support the tilt shaft and that is spaced apart from the left support in the left-right direction of the outboard motor; and the seal is located between the left support and the right support.

8. The outboard motor according to claim 1, wherein the outboard motor body includes a propeller and an electric motor to drive the propeller; and the harness is connected to the electric motor.

* * * * *